United States Patent [19]

Dailey

[11] 4,369,699

[45] Jan. 25, 1983

[54] CAN FOLDING AND FLATTENING DEVICE

[76] Inventor: Harold E. Dailey, 6043 W. Crestwood Way #3, Glendale, Ariz. 85301

[21] Appl. No.: 241,481

[22] Filed: Mar. 9, 1981

[51] Int. Cl.[3] ..... B30B 3/02

[52] U.S. Cl. ..... 100/156; 100/902

[58] Field of Search ..... 100/156, 176, 902, 233; 241/189 R, 191

[56] References Cited

U.S. PATENT DOCUMENTS

| | | | |
|---|---|---|---|
| 2,808,776 | 10/1957 | Palmer | 100/156 X |
| 3,608,477 | 9/1971 | Weber | 100/156 |
| 3,827,351 | 8/1974 | Rosenow | 100/176 |
| 3,980,015 | 9/1976 | Woodward | 100/902 X |
| 4,151,959 | 5/1979 | Deister | 241/189 R |
| 4,212,242 | 7/1980 | Willis | 100/902 X |
| 4,292,891 | 10/1981 | Shelley | 100/902 X |

*Primary Examiner*—Peter Feldman
*Attorney, Agent, or Firm*—James F. Duffy

[57] ABSTRACT

A rotating force vector is applied to the sidewall of a can at a sufficient distance removed from the end of that can to permit the easy distortion of that sidewall and the ready rotation of the can-end toward a plane which lies essentially parallel to the cylindrical axis of the can. Means are provided to further distort the can and, through the second application of a rotating force vector, to rotate the second end of the can into a plane essentially parallel with the cylindrical axis of the can. Flattening means applied to the can after each revolution of a can-end tends to bring the planes into which the can-ends lie into close juxtaposition so as to provide a relatively flat package requiring comparatively little storage space when compared to the amount of space required to store the original undistorted can.

20 Claims, 10 Drawing Figures

CAN FOLDING AND FLATTENING DEVICE

BACKGROUND

1. Field of the Invention

The invention relates to the field of metal salvage. In particular, the invention relates to the salvage of metal from cans originally manufactured to contain beverages. Most specifically, the invention, in the embodiment disclosed, relates to the salvage of aluminum from aluminum beverage containers by reducing the amount of storage space necessary to store such containers until a sufficient number is accumulated to bring to a salvage depot.

2. Prior Art

During the second World War, we were a conservation minded nation. The prosperity and technological advances achieved after that war have helped turn us into a wasteful and waste filled nation. The realization, however, has finally come to many that such wasteful existence cannot endure. People are demanding that such waste shall cease. More and more we see or hear of goods being made from recycled paper, reprocessed wool, recycled metals, etc.

One consumer product which is readily recycleable is the aluminum can in which beverages are sold. So many people have turned to the salvage of aluminum cans that a ready market exists for such material today. To discourage persons from retaining and salvaging such cans is the storage problem that exists. Thirty empty cans can fill an ordinary paper grocery bag to overflowing. Since, in storing cans, the consumer is storing a more significant volume of air than of aluminum, the can rapidly consume storage space and threaten to overflow the household.

To conserve storage space, those skilled in the art have developed means for flattening the cans. Couty et al. in U.S. Pat. No. 3,066,600 issued Dec. 4, 1962, discloses means for flattening cans which comprises two synchronized rollers rolling in opposite directions to draw cans down between the rollers. A depression is cut into the rollers to permit the bottom of a can to be gripped and then bent so as to cause the base of the can to be compressed and allow it to be drawn downward between the two rollers drawing the remainder of the can with it.

Rosenow in U.S. Pat. No. 3,827,351 issued Aug. 6, 1974, uses a similar concept of synchronized rollers for flattening metal cans. However, Rosenow's rollers have substantially square cross-sections with rounded edges. This provides a vise-like action at the flat surfaces of the rollers which flattens and crushes cans entrapped therebetween.

It is quite common to find crushing devices which are provided with a rotary cylinder and a compression wall. The patents to Smorenburg, U.S. Pat. No. 3,0830,153; and to Palmer, U.S. Pat. No. 2,808,776; are illustrative of crushers having a rotary cylinder and a fixed wall compression plate.

The combination of a rotary cylinder and a fixed wall compression plate frequently resulted in material jamming between the roller and the compression plate. To overcome this tendency, those skilled in the prior art resorted to movable compression plates. Generally, these compression plates were spring-loaded so as to retract under high loads which would nominally have resulted in jamming the device. When the potential jamming material has cleared the machine, the spring-loading of the compression plate brings it back to its normal close proximity to the rotating cylinder. Typical of such devices are those by Hughes, U.S. Pat. No. 1,509,730; and Williams, U.S. Pat. No. 973,327.

Malarsky, in U.S. Pat. No. 3,036,517, eliminates the rotary cylinder in favor of a combination of a fixed compression plate and an undulating, curved surface compression plate. Cans are deposited between the two compression plates and work their way down therebetween as the curved compression plate is undulated.

Weber et al in U.S. Pat. No. 3,608,477 combines a rotary cylinder with an undulated compression plate, thus, achieving somewhat greater simplicity than the device of Malarsky.

All of the above note devices are relatively complex. Those which require two synchronized rollers are relatively elaborate in and of themselves and require the use of gearing to obtain the necessary synchronization. It is noted, too, that the rollers of Couty et al. and Rosenow are specially shaped, a factor which detracts from the overall cost effectiveness of the device.

An examination of the prior art indicates that a device which will provide the consumer a simple means for crushing cans within the home environment is highly desired. Further, no simple, relatively inexpensive device for such a purpose is presently known.

It is therefore an objective of the present invention to provide a relatively simple and inexpensive device for use in the home for the flattening of cans to conserve storage space consumed by such cans until they are taken to the salvage depot.

It is a particular object of the invention of provide a highly efficient device requiring relatively little energy be expended in flattening aluminum beverage cans.

It is a specific objective of the invention to provide a device which will flatten an aluminum beverage can with little or no distortion of the top and bottom ends of the can thus conserving energy normally expended in other devices to distort such structurally sound elements of the can.

SUMMARY OF THE INVENTION

The invention is intended for folding cans having top and bottom ends nominally lying in planes perpendicular to the cylindrical axis of the can. Means are provided for rotating a first end of a can into a plane which is essentially parallel to the cylindrical axis of the can. Second rotating means rotate the second end of the can into a second plane which is again essentially parallel to the cylindrical axis of the can. Flattening means are utilized to bring the plane in which the first end of the can has been folded into close juxtaposition with the plane into which the second end of the can has been folded. Pressure means are used to apply a force at a point on the sidewall a sufficient distance above the end of the can to permit the sidewall to be easily distorted. Means for resisting the thrust delivered to the can by the application of such force are provided to maintain the relative position of the can as the force is applied to the cylindrical wall thereof. The pressure means is further provided with means for rotating the force vector applied to the side of the can causing the can to be further distorted and producing a rotation of a first end of the can toward a first plane essentially parallel to the cylindrical axis of the can. A second pressure means applies a force to the second end of the can, for example the top end, this second pressure means likewise rotates the force vector and causes the walls of the can to be further distorted while rotating the second, or top, end of the can into a second plane essentially parallel to the cylindrical axis of the can. Flattening means are then employed to further distort the walls of the can and to bring the planes in which the first and second ends of the can are lying into close juxtaposition.

DETAILED DESCRIPTION OF THE INVENTION

Figure 1A:
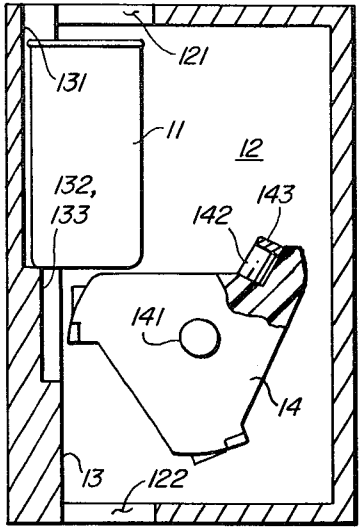
FIGS. 1A–1H provide sectional side elevations of the invention illustrating the sequential steps in the folding and flattening of a can by the invention.

The invention is a device which combines both folding and flattening operations. Both the top and bottom ends of a can are folded into planes essentially parallel with the cylindrical axis of the can. As each end is folded, a flattening operation is performed so that the planes in which the can-ends have been folded will lie in close juxtaposition. The term "essentially parallel" is utilized herein in the same manner as would the terms "roughly parallel" or "approximately parallel." No mathematical nicety is to be inferred from the use of the term. So far as a user of the device is concerned, when a can has been folded and flattened, its ends lie in planes which are essentially parallel to the cylindrical axis of the can although that can no longer resembles a cylinder.

Referring to FIGS. 1A–1H, it will be seen how the various parts of the invention cooperate, one with another, to achieve a folding and flattening of a beverage can. The can folding device is represented by the general reference 10. Can 11 is to be folded and flattened by can folder 10. Can 11 is comprised of a top end 111 and a bottom end 112.

Can folder 10 is comprised of an enclosure 12 having an entry 121 through which can 11 enters the device, and an exit 122 through which the folded can 11 is ejected. Wall 13 of enclosure 12 provides the thrust resistant means to maintain can 11 in a relatively stable position during the course of the folding and flattening operation on can 11.

A rotary folding and flattening element is comprised of body 14 which is coupled to shaft 141. Shaft 141 provides the means for rotating body 14 about the axis of shaft 141. In describing body 14 in detail, reference may be had to FIGS. 2 and 3 as well as the illustrations in FIG. 1.

Body 14 may be cast of a durable plastic material. Radial surfaces are provided with recesses 142 such that when pressure plate 143 is brought to bear against the sidewall of can 11, for example at reference point 15, all of the force applied to the can 11 by pressure plate 143 will be concentrated along edge 1431 of pressure plate 143, recess 142 preventing such force from being distributed along a radial face of body 14.

Body 14 is comprised of several cylindrical segments 145 topped by anti-slip nubbins 144. The surface of pressure plate 143 conforms to the surface of the cylindrical segments 145 of body 14. Anti-slip nubbins 144 reduce any tendency for slippage between the rotating body 14 and the can 11 being folded and crushed.

Figure 2:
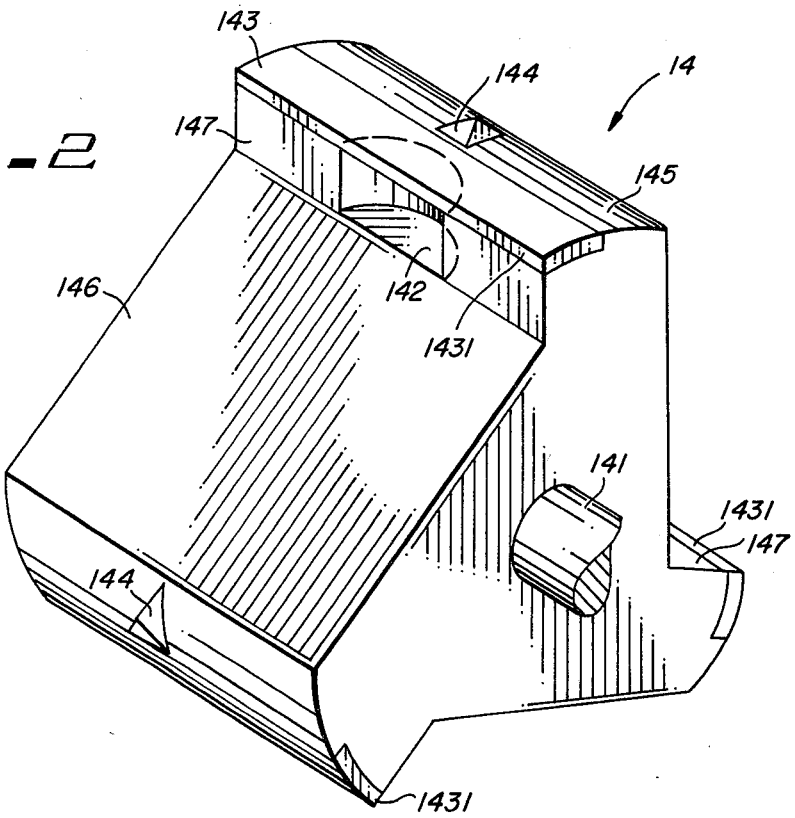
FIG. 2 illustrates the rotary pressure and flattening elements of the invention.
Figure 3:
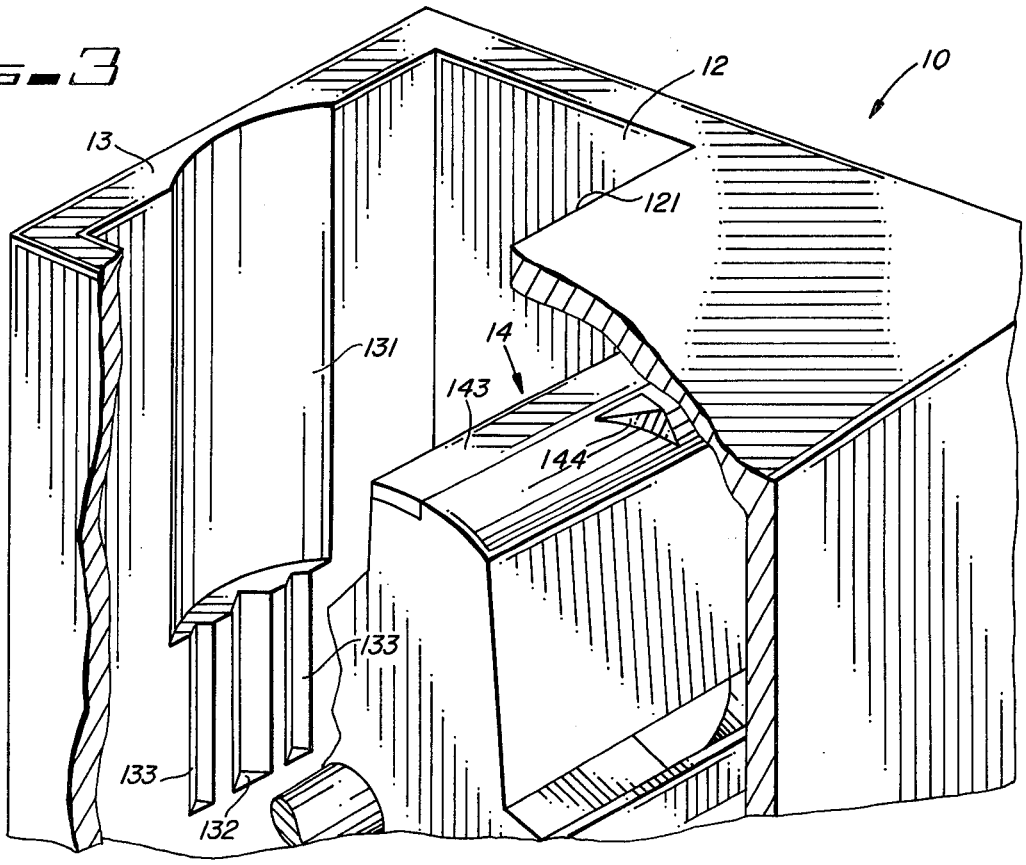
FIG. 3 is a partial section, perspective view of the inner workings of the device showing the relationship of the rotary pressure and flattening element to the thrust resistent wall of the device.

The manner in which the device functions is best illustrated in the sequence of FIGS. 1A through 1H. Supplementary reference to FIGS. 2 and 3 is also recommended. In FIG. 1A, can 11 has been deposited through entry 121 of enclosure 12. Can 11 has been brought to rest within the cylindrical recess 131 in wall 13.

Figure 1B:
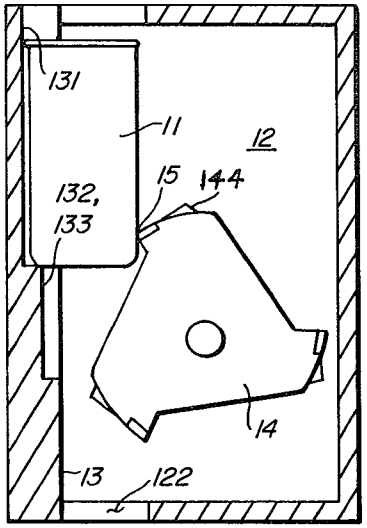
Figure 1C:
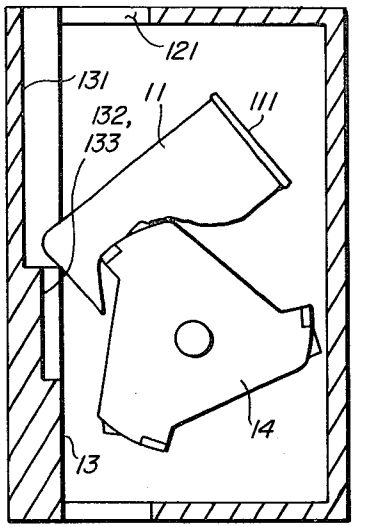

In FIG. 1B, shaft 141 has caused body 14 to rotate so as to cause edge 1431 of pressure plate 143 to contact the sidewall of can 11 at reference point 15. Reference point 15 is a sufficient distance above the bottom end 112 of can 11 to permit the sidewall to be readily and easily distorted by the force vector resulting from the rotation of body 14 and the contact of the can 11 by pressure plate 143.

As body 14 continues in its rotation, can 11 pivots toward axis 141 as its sidewall is distorted and its bottom end 112 begins to revolve downward about the edge of recess 131. The top of pressure plate 143, as well as the cylindrical segment surfaces 145 of body 14, provide the means for flattening the walls of can 11. Anti-slip nubbin 144 maintains the relative position of the can 11 with body 14 so as to draw the can 11 downward as body 14 rotates causing further distortion of the can wall and permitting can bottom 112 to further revolve and to eventually fold itself into a plane essentially parallel with the cylindrical axis of the can.

Figure 1D:
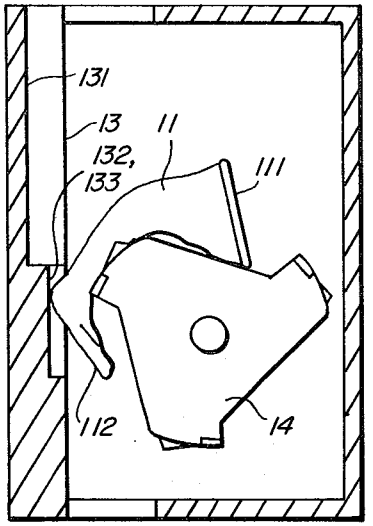
Figure 1E:
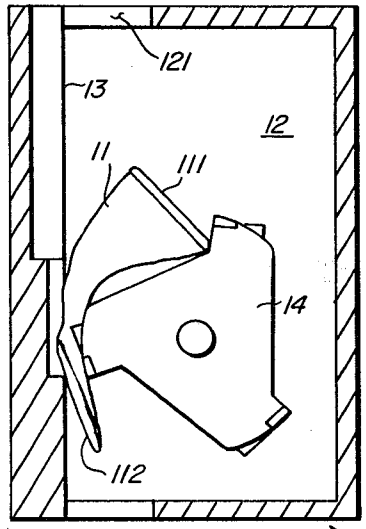
Figure 1F:
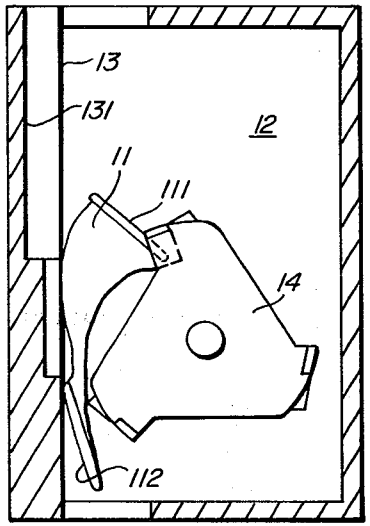
Figure 1G:
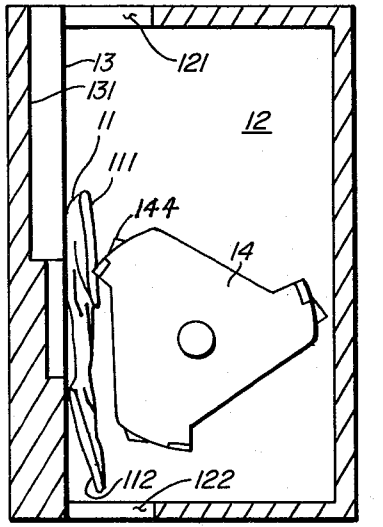
Figure 1H:
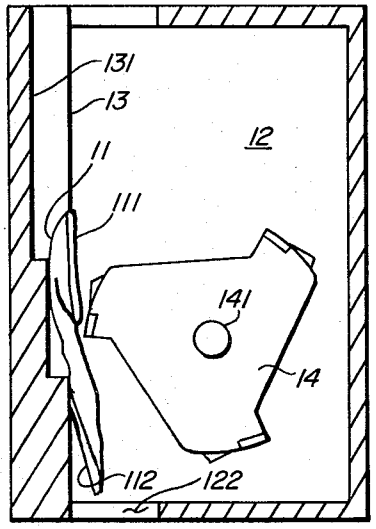

FIGS. 1D and 1E show the further folding of can bottom end 112 and the flattening of the sidewalls of can 11. Also shown in FIGS. 1D and 1E is the manner in which the can top 111 is drawn toward recess 142 in a radial face 147 of body 14. As is best illustrated in FIG. 1F, continued rotation of body 14 will bring pressure plate 143 to bear on the top wall 111 of can 11. Application of a rotating force vector to the top of the can causes the can top 111 to be folded down into a second plane which is essentially parallel to the cylindrical axis of the can. This action is best illustrated in FIGS. 1G and 1H. The rotating force vector, of course, results from the rotation of body 14 and the contact of pressure plate 143 with the can 11. Again, a nubbin 144 on the cylindrical segment flattening surfaces 145 of body 14 tends to retain the relative position of can 11 with respect to body 14 so that a rolling, flattening effect is achieved.

In practicing the invention, it has been found that the provision of recessed tracks 132 and 133 in wall 13 below cylindrical recess 131 greatly reduces the power requirements for folding and flattening beverage cans. The utility of such recessed tracks 132 and 133 is believed to derive from the unique manner in which the invention folds rather than crushes the top and bottom ends of the can. Since the top and bottom ends of the can remain virtually undistorted in the course of the folding and flattening operation, these can ends retain their structural strength and rigidity. Providing recessed tracks 132 and 133 eases the passage of these structures downward through enclosure 12 between the thrust resistent element provided by wall 13 and the rotating cylindrical segments of body 14 utilized as flattening means. Foregoing the compressive distortion and flattening of the can ends greatly reduces the amount of energy initially expended in folding and flattening the cans. Providing recessed tracks 132 and 133 further reduces that energy that needs be expended in moving the flattened can downward and out of the device.

In practicing the invention, it has been determined that one hundred cans which have been folded and flattened by the invention may be stored in the same space originally required for storing thirty undistorted cans.

In the preferred embodiment, body 14 is disclosed as having three radial faces 147 and three cylindrical segments 143. For expository purposes, rather than limitation, the embodiment of the invention has been disclosed for use with beverage cans. The illustrations of FIGS. 1A through 1H are an artist's concept of the stages a twelve-ounce beverage can passes through while being folded and flattened. The passage of can 11 past two cylindrical segments 143 is sufficient to fold and flatten a twelve-ounce can.

If can 11 were a sixteen-ounce can, all three cylindrical segments 143 would be employed in the folding and flattening process. The first would rotate can end 112; the second would distort and flatten the central section of can 11; while the third would rotate can end 111.

The size of body 14 may be optimized for the type of cans to be folded. In the beverage can embodiment disclosed, the radius of the cylindrical sections 143 was two and five-eights inches. This dimension, provided by way of illustration only, worked efficiently in folding and flattening beverage cans. The teachings herein are, of course, not limited to a particular type or style of can. What has been disclosed is a means for applying a rotating force vector to the sidewall of a can at a sufficient distance removed from the end of that can to permit the easy distortion of that sidewall and the ready rotation of the can end toward a plane which lies essentially parallel to the cylindrical axis of the can. Means have been provided to further distort the can and, through the second application of a rotating force vector, to rotate the second end of the can into a plane essentially parallel with the cylindrical axis of the can. Flattening means applied to the can after each revolution of a can end tends to bring the planes into which the can ends lie into close juxtaposition so as to provide a relatively flat package requiring comparatively little storage space when compared to the amount of space required to store the original undistorted can.

Those skilled in the art will readily draw other embodiments of the invention from the teachings set forth herein. It is intended that all such embodiments so drawn shall fall within the ambit of protection of the claims appended hereto.

Having described the invention in the foregoing specification and the drawings accompanying it in such a clear and concise manner that those skilled in the art may readily understand and easily practice the invention, that which I claim is:

1. A can folding device for folding cans, said cans having first and second ends nominally lying in planes perpendicular to the cylindrical axis of said cans comprising:

first and second rotary means having a common axis of rotation said first rotary means comprising:

means for rotating a first end of a can to a first plane essentially parallel to the cylindrical axis of the can; and, coupled thereto said second rotary means comprising:

means for rotating a second end of the can to a second plane essentially parallel to the cylindrical axis of the can.

2. The can folding device of claim 1 further comprising:

flattening means for bringing said first plane and said second plane into close juxtaposition.

3. The can folding device of claim 1 wherein said means for rotating a first can-end comprises:

first pressure means for directly applying a force vector to the cylindrical wall of a can at a point on that wall a sufficient distance removed from a first end of the can to easily distort said wall; and first thrust resistant means for maintaining the relative position of the can as said force vector is applied to the cylindrical wall thereof.

4. The can folding device of claim 3 wherein said first pressure means further comprises means for rotating said force vector to further distort the cylindrical wall of the can and to rotate said first can-end toward a first plane essentially parallel to the cylindrical axis of the can.

5. The can folding device of claim 4 wherein said means for rotating a second end of a can comprises second pressure means for applying a second force vector to a second end of a can whose cylindrical wall has been distorted by said first pressure means; and second thrust resistant means for maintaining the relative position of the can as said second force vector is applied to said second can-end.

6. The can folding device of claim 5 wherein said second pressure means further comprises means for rotating said second force vector to further distort the cylindrical wall of the can and to rotate said second can-end toward a second plane essentially parallel to the cylindrical axis of the can.

7. The can folding device of claim 6 further comprising flattening means for bringing said first plane and said second plane into close juxtaposition.

8. The can folding device of claim 1 wherein said means for rotating a first end of a can comprises first rotating pressure means for applying a rotational force vector to the cylindrical wall of the can at a point on that wall a sufficient distance from said first can-end to easily distort said wall and rotate said first can-end toward a first plane essentially parallel with the cylindrical axis of the can.

9. The can folding device of claim 8 wherein said means for rotating a second end of the can comprises second rotating pressure means for applying a rotational force vector to the second end of the can to further distort the cylindrical wall of the can and rotate said second can-end toward a second plane essentially parallel with the cylindrical axis of the can.

10. The can folding device of claim 9 wherein said first rotating pressure means comprises a first pressure plate coupled to a first rotating cylindrical segment.

11. The can folding device of claim 10 wherein said second rotating pressure means comprises a second pressure plate coupled to a second rotating cylindrical segment.

12. The can folding device of claim 11 further comprising means for rotating said first and said second cylindrical segments about a common axis of rotation.

13. The can folding device of claim 12 wherein said first and said second cylindrical segments further comprise flattening means for further distorting said cylindrical wall of the can and bringing said first plane and said second plane into close juxtaposition.

14. The can folding device of claim 13 wherein said first and said second cylindrical segments further comprise anti-slip means for maintaining the can in contact with said flattening means as said cylindrical segments are rotated about their axis of rotation permitting said cylindrical segments to apply a rolling compressive force to the can to flatten it and bring said first and said second planes into close juxtaposition.

15. The can folding device of claim 14 wherein said anti-slip means comprises a raised nubbin atop each of said cylindrical segments.

16. A can folding device for folding cans, said cans having first and second ends nominally lying in planes perpendicular to the cylindrical axis of said cans comprising:

first rotating pressure means comprising a first pressure plate coupled to a first rotating cylindrical segment for directly applying a rotational force vector to the cylindrical wall of a can at a point on that wall a sufficient distance from said first can-end to easily distort said wall and rotate said first can-end toward a first plane essentially parallel with the cylindrical axis of the can; and second rotating pressure means comprising a second pressure plate coupled to a second rotating cylindrical segment for directly applying a rotational force vector to the second end of the can to further distort the cylindrical wall of the can and rotate second can-end toward a second plan essentially parallel with the cylindrical axis of the can.

17. The can folding device of claim 16 further comprising means for rotating said first and said second cylindrical segments about a common axis of rotation.

18. The can folding device of claim 17 wherein said first and said second cylindrical segments further comprise flattening means for further distorting said cylindrical wall of the can and bringing said first plane and said second plane into close juxtaposition.

19. The can folding device of claim 18 wherein said first and said second cylindrical segments further comprise anti-slip means for maintaining the can in contact with said flattening means as said cylindrical segments are rotated about their axis of rotation permitting said cylindrical segments to apply a rolling compressive force to the can to flatten it and bring said first and said second planes into close juxtaposition.

20. The can folding device of claim 19 wherein said anti-slip means comprises a raised nubbin atop each of said cylindrical segments.

* * * * *